US005347932A

United States Patent [19]

Gardner et al.

[11] Patent Number: 5,347,932

[45] Date of Patent: Sep. 20, 1994

[54] SHOT WAD WITH HIGHLY COLLAPSIBLE HINGE PORTION

[75] Inventors: Robert J. Gardner, Bethalto, Ill.; Morris C. Buenemann, Jr., Florissant, Mo.

[73] Assignee: Olin Corporation, East Alton, Ill.

[21] Appl. No.: 66,353

[22] Filed: May 21, 1993

[51] Int. Cl.[5] ..... F42B 7/08

[52] U.S. Cl. ..... 102/451; 102/532

[58] Field of Search ..... 102/448–463, 102/532

[56] References Cited

U.S. PATENT DOCUMENTS 3,402,664 9/1968 Cramer .
3,575,113 4/1971 Ashbrook et al. ..... 102/451
3,750,579 8/1973 Bellington ..... 102/451
4,004,522 1/1977 Furniss et al. ..... 102/451
4,220,090 9/1980 Fackler ..... 102/451
4,773,329 9/1988 Bilsbury .
4,782,759 11/1988 Hawk ..... 102/450

*Primary Examiner*—Harold J. Tudor
*Attorney, Agent, or Firm*—Gregory S. Rosenblatt

[57] ABSTRACT

The invention uses a pair of curved opposed diagonal bars between the wad and cup. The bars (deformable resistance members) buckle in the radial direction and end up basically flat between the wad and cup to give surprisingly and unexpectedly high amounts of collapse (80% or more). This allows the space between wad and cup to be decreased significantly without sacrificing cushioning.

17 Claims, 1 Drawing Sheet

SHOT WAD WITH HIGHLY COLLAPSIBLE HINGE PORTION

BACKGROUND OF THE INVENTION

Cross-Reference to Related Applications

This is an original application.

1. Field of Invention

This invention relates generally to ammunition and more particularly to wads for shotshells.

2. Description of the Related Art

Shot wads have been in existence for more than a century, and plastic shot wads have been used in shotshells for several decades. Combination shot cup and over powder wads have been used for more that 25 years. One piece shot wads such as the Winchester AA are widely known and used. Most existing collapsible shot wads have a hinge section which collapses to roughly 50% of the initial height. With the recent change from lead shot to steel shot in many shooting areas due to environmental concerns over lead, the space in shotshells has become much tighter due to the larger volume of steel shot needed to produce equivalent results.

The collapsible section of a wad is very useful for several reasons. First, it allows some internal adjustment for normal variations in the volume of propellant and shot charged into a shell by conventional loading equipment and thus gives more consistent shotshell closures or crimps. Secondly, the additional volume created by the collapsing of the wad slows the very rapid pressure buildup upon firing and thus lowers the resultant peak pressure. In shotshell ammunition where load performance is constrained by peak pressure levels, this pressure mitigation can be used to achieve higher velocities with a given propellant or to allow the use of a faster, cleaner burning propellant to achieve the same velocities. For target shooting, the slower pressure rise and lower peak pressure results in softer felt recoil, which can help with accuracy and comfort, especially in competitive shooting where hundreds of shots may be 10 fired in a day.

A new technical approach is needed which can allow more collapse in limited space to increase the benefit of collapsibility in the smaller axial wad space available in modern shotshells.

SUMMARY OF THE INVENTION

Brief Technical Description

The invention provides an axially collapsible wad having a pair of radially deformable opposed diagonal resistance members ("hinges") between a pair of axially spaced transverse walls. The hinges are preferably curved radially rather than axially to promote radial rather than axial collapse and are preferably attached to the walls at an acute angle in the axial direction, preferably attached to the walls at an acute angle in the radial direction, and preferably attached near the outer rim of the walls to maximize their length.

BRIEF DESCRIPTION OF THE DRAWINGS

The invention will be better understood by reference to the enclosed drawing in which.

DETAILED DESCRIPTION OF THE INVENTION

Technical Basis for the Invention

The invention stems from a thorough understanding of the manner in which shotshell wads work and the purposes they serve. The recognition that angular attachment of the hinges reduces the likelihood of hinge separation was important. The use of radial buckling was a major key to minimize the axial length of the hinge section required for cushioning and to allow a higher percentage of axial collapse in the hinge section.

Preferred Embodiments

Figure 1:
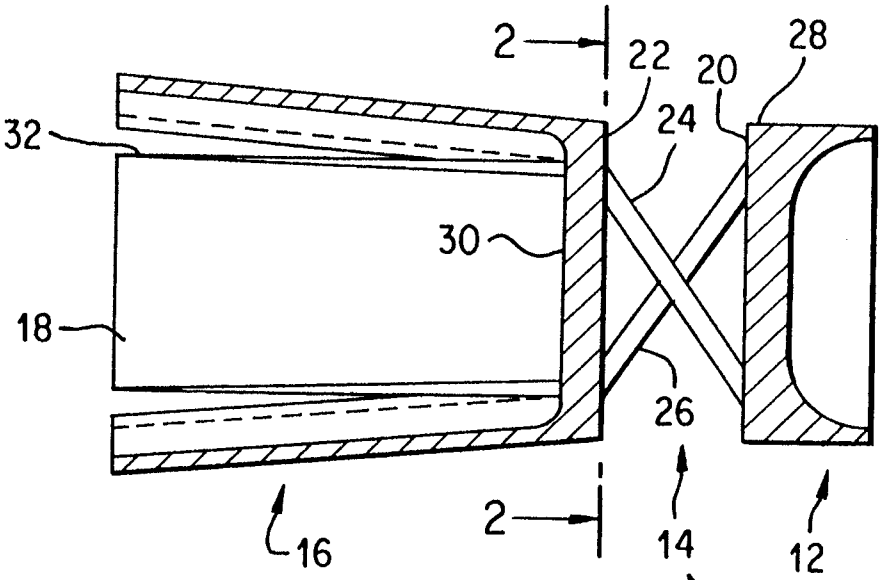
FIG. 1 is an axial cross section of the preferred wad of the invention with the resistance members shown not in section for clarity.

Referring first to FIG. 1, a collapsible combination one-piece shot cup and obturator cup unit or "wad" 10 is shown having an obturator cup 12, a hinge (collapsible) section 14 and a shot cup 16. The entire unit 10 is preferably made of high density polyethylene material by injection molding. The obturator cup 12 is a shallow cup-shaped solid plastic obturator body having a flat transverse wall and is designed to minimize propellant gases passage past the wad during use from right to left in FIG. 1. By "transverse" is meant at right angles to the axis of the unit. Cup 16 is a cup shaped plastic body with the cup wall being split to produce a plurality of symmetrical petals.

The hinge section 14 has four basic parts: a first transverse wall 20, a second transverse wall 22, a first deformable resistance member 24 and a second deformable resistance member 26. The two transverse walls 20,22 are spaced axially from but coaxial with each other. For simplicity of manufacture, the four basic parts are all that are preferably present, although other parts could be added provided the highly collapsible nature of the section is not altered.

Figure 2:
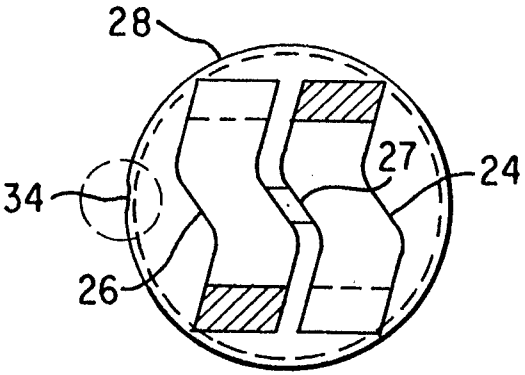
FIG. 2 is a transverse cross section taken along lines 2—2 of FIG. 1 showing a preferred nested double S hinge configuration.

The hinge section 14 is better seen by referring to FIG. 1 and FIG. 2. The members 24, 26 are of generally identical S-shaped configuration and lie side by side when viewed from above or below (i.e., from left or right in FIG. 1, respectively.) The members are thicker in the radial direction than in the axial direction. However, by contouring the shape in the radial direction, the members are predisposed to buckle radially along their diagonal length to shorten diagonally in response to axial compression of the unit. The members 24,26 are attached at an angle to the transverse walls at the edge 28 of the wall to maximize their length. The nested double-S configuration also aids in preventing separation of the members from the transverse walls by dividing the radial collapse into two components (one left and one right) to reduce stress on the attachment points of the members to the walls. In the event an opposed pair of C-shaped members are used instead of the S-shaped members, the same angle attachment would be used. The members are preferably connected at their mid-points by a transverse connector 27 to facilitate molding and maintain spacing of the members 24 and 26. Also, the absence of vertical members in the hinge section and the lack of any impingement of the resistance members upon each other during collapse allows a surprisingly high percentage collapse for the collapsible section of the wad. In fact, collapses of 80–90% from the original height of the hinge section prior to loading can be achieved with the invention, since the height after collapse is limited just by the axial thickness of the members 24 and 26. By contrast, most existing collapsible sections collapse to about 50% of the initial height.

The shot cup 16 preferably has a frustoconical configuration when the splits 32 are fully closed, so that the shot cup will fully close circumferentially without significant gaps and will precisely fit into the interior of a shotshell having a slightly tapered interior such as a compression formed Winchester AA brand shotshell. However, the cup could be a right cylindrical cup for use in extruded tubes having a straight side wall. A shot cup liner such as shown in U.S. Pat. No. 4,773,329 could be utilized, if desired, or, to decrease shot cup volume, the bottom inside surface 30 of the shot cup could be altered as desired for different applications. The splits in the walls of shot cup 16 are V-shaped and the petals flared outwardly prior to loading. This allows the splits 32 to close up as the cup is compressed radially inward during loading of the unit into a shot shell.

Figure 3:
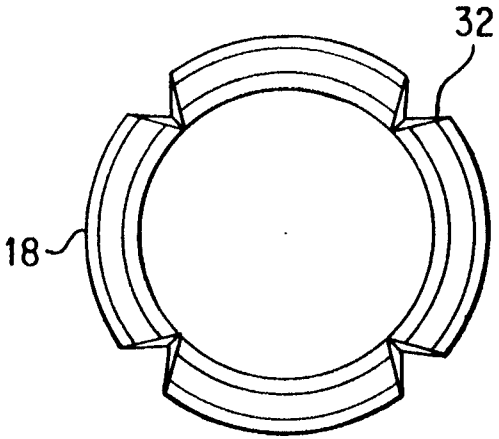
FIG. 3 is a top plan view of the wad of FIG. 1 showing the petal configuration in the shot cup.

FIG. 3 shows these V-shaped splits 32 and outward flared petals which preferably close to form a substantially continuous wall when loaded into a shotshell.

Figure 4:
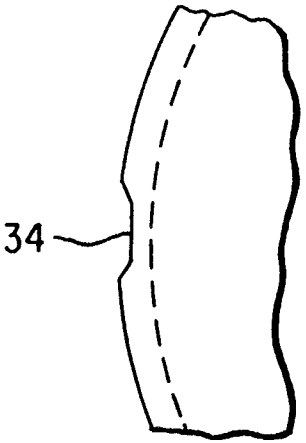
FIG. 4 is an enlarged view of the indicated portion of FIG. 2 showing a vent groove.

FIG. 4 shows the use of axial vent grooves 34 in the wad side wall so as to avoid trapped gas under the wad during loading. These grooves 34 close up in response to the high pressures behind cup 12 generated by shotgun propellants during use of unit 10.

MODIFICATIONS AND INCORPORATIONS BY REFERENCE

Modifications

While the invention has been described above and below with references to preferred embodiments and specific examples, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure.

Incorporations by Reference

All patent applications, patents and other publications cited herein are incorporated by reference in their entirety as if they were set forth at length.

What is claimed is:

1. An axially collapsible shot wad comprising:

a first transverse wall;

a second transverse wall coaxially with and axially spaced from the first transverse wall;

a first radially deformable radially arched resistance member attached to an opposite edge of each of the transverse walls and extending diagonally between the transverse walls; and a second radially deformable radially arched resistance member radially spaced from the first resistance member and attached to an opposite edge of each of the transverse walls and extending diagonally between the transverse walls in a direction opposite the first member to form a spaced axially crossing x-shape configuration, said first resistance member and said second resistance member having a generally side by side nested configuration when viewed from a transverse wall.

2. The wad of claim 1, wherein the first transverse wall is an obturator cup.

3. The wad of claim 2 wherein the second transverse wall is a shot cup.

4. The wad of claim 3 wherein the shot cup has a plurality of forwardly flared petals which form a frustoconical side wall fully closed circumferentially.

5. The wad of claim 1 wherein the resistance members are attached to the transverse walls at an acute angle in the radial direction.

6. The wad of claim 1 wherein the transverse walls have an outer edge and the resistance members attach adjacent to the outer edge.

7. The wad of claim 6 wherein the resistance members have radial width greater than their axial thickness but have greater bend resistance in the axial direction than radial direction, whereby the resistance members are predisposed to buckle radially upon axial compression.

8. The wad of claim 1 wherein the resistance members are attached to the transverse walls at an acute angle in the axial direction.

9. The wad of claim 8 wherein the resistance members are attached to the transverse walls at an acute angle in the radial direction.

10. The wad of claim 1 wherein the center portions of the resistance members are spaced from outer edges of the transverse walls by a distance sufficient to provide room for the resistance members to collapse by a distance sufficient to allow the original as-molded axial distance between the transverse walls to decrease by at least 80% upon full axial compression of the wad.

11. The wad of claim 1 wherein the resistance members are thicker in the radial direction than in the axial direction.

12. The wad of claim 1 wherein the arch of the members is angular.

13. The wad of claim 1 wherein said first resistance member and said second resistance member are connected at a midpoint.

14. The wad of claim 13 wherein said first resistance member and said second resistance member are joined by a transverse connector.

15. The wad of claim 14 wherein said first resistance member and said second resistance member and said transverse connector are molded as a single unit.

16. An axially collapsible shot wad comprising:

a first transverse wall;

a second transverse wall coaxial with and axially spaced from the first transverse all;

a first radially deformable radially arched resistance member attached to an opposite edge of each of the transverse walls and extending diagonally between the transverse walls; and a second radially deformable radially arched resistance member radially spaced from the first resistance member and attached to an opposite edge of each of the transverse walls and extending diagonally between the transverse walls in a direction opposite the first member to form a spaced axially crossing x-shaped configuration wherein said first resistance member and said second resistance member are a pair of radially nested S-shaped bars.

17. An axially collapsible shot wad comprising:

a first transverse wall;

a second transverse wall coaxially with and axially spaced from the first transverse wall;

a first radially deformable radially arched resistance member attached to an opposite edge of each of the transverse walls and extending diagonally between the transverse walls; and a second radially deformable radially arched resistance member radially spaced from the first resistance member and attached to an opposite edge of each of the transverse walls and extending diagonally between the transverse walls in a direction opposite the first member to form a spaced axially crossing x-shaped configuration wherein said first resistance member and said second resistance member are connected at their midpoints by an integral transverse connector.

* * * * *